US010435209B2

(12) United States Patent
Painchaud et al.

(10) Patent No.: US 10,435,209 B2
(45) **Date of Patent: *Oct. 8, 2019**

(54) DEVICE FOR THE SECURE CLOSURE OF A CONTAINER BY SCREWING WITH RETRACTABLE TAB

(71) Applicant: Nemera La Verpillière S.A.S., La Verpilliere (FR)

(72) Inventors: Gaëtan Painchaud, Francheville (FR); Thierry Decock, Lyons (FR); Jose Camba, Amberieu en Bugey (FR)

(73) Assignee: Nemera La Verpilliere (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/570,060

(22) PCT Filed: Apr. 25, 2016

(86) PCT No.: PCT/FR2016/050971

§ 371 (c)(1),
(2) Date: Oct. 27, 2017

(87) PCT Pub. No.: WO2016/174337

PCT Pub. Date: Nov. 3, 2016

(65) Prior Publication Data

US 2018/0105333 A1 Apr. 19, 2018

(30) Foreign Application Priority Data

Apr. 28, 2015 (FR) ..... 15 53787

(51) Int. Cl.
*B65D 50/04* (2006.01)

(52) U.S. Cl.
CPC ..... *B65D 50/046* (2013.01); *B65D 2215/02* (2013.01); *B65D 2543/00435* (2013.01)

(58) Field of Classification Search
CPC ..... B65D 2543/00435; B65D 50/046; B65D 50/048

(Continued)

(56) References Cited

U.S. PATENT DOCUMENTS 4,429,800 A * 2/1984 Greenspan ..... B65D 50/045 215/216
4,948,002 A * 8/1990 Thornock ..... B65D 50/046 215/216

(Continued)

FOREIGN PATENT DOCUMENTS

CN 1156434 A 8/1997
CN 104797503 A 7/2015

(Continued)

*Primary Examiner* — Anthony D Stashick
*Assistant Examiner* — Raven Collins
(74) *Attorney, Agent, or Firm* — St. Onge Steward Johnston & Reens, LLC

(57) ABSTRACT

A closure device for closing a container, including a coupling member with an external thread and a cap with an internal thread intended to be positioned on the coupling member or to be removed from the coupling member by screwing or unscrewing. The closure device also includes security features with at least one circumferential locking stop and at least one locking tab that is radially deformable between a rest position in which the tab cooperates with the circumferential locking stop to prevent unscrewing of the cap and at least one retracted position for releasing the tab relative to the circumferential stop. The tab is carried by the coupling member, and the circumferential stop is carried by the cap.

17 Claims, 4 Drawing Sheets

(58) Field of Classification Search
USPC ..... 215/209
See application file for complete search history.

(56) References Cited

U.S. PATENT DOCUMENTS

| | | | | |
|---|---|---|---|---|
| 5,413,233 | A * | 5/1995 | Hall | B65D 50/046 215/209 |
| 6,112,921 | A | 9/2000 | Robinson | |
| 7,641,064 | B2 | 1/2010 | Robinson | |
| 7,959,034 | B2 * | 6/2011 | Faaborg | B65D 41/0471 222/109 |
| 9,950,844 | B2 * | 4/2018 | Barber | B65D 50/045 |
| 2006/0108312 | A1 | 5/2006 | Robinson | |
| 2014/0284299 | A1 * | 9/2014 | Barber | B65D 50/045 215/44 |

FOREIGN PATENT DOCUMENTS

| | | | |
|---|---|---|---|
| EP | 0780317 | A1 | 6/1997 |
| WO | 09307071 | A1 | 4/1993 |
| WO | 2009050457 | A1 | 4/2009 |
| WO | 2012170731 | A1 | 12/2012 |

* cited by examiner

DEVICE FOR THE SECURE CLOSURE OF A CONTAINER BY SCREWING WITH RETRACTABLE TAB

FIELD OF THE INVENTION

The present invention relates to a closure device intended to be borne by a tank-forming container. The container is for example intended to receive a pharmaceutical product in fluid form and can be provided with a possibly metered distribution pump.

BACKGROUND OF THE INVENTION

As is known, the market offers pharmaceutical products sold in flasks comprising, more often than not, a tank-forming container onto which is added a dispensing end-fitting forming, for example, a metering pump.

Conventionally, the dispensing end-fitting is protected by a closure device comprising a cap intended to be fitted onto the container or be removed from this container by a movement of screwing/unscrewing of the cap on the container.

With the regulations constantly changing, more and more countries are demanding pharmaceutical products in flasks sold in their territories to have secured closure means, commonly called CRC, from the acronym "child resistant closure packaging".

Such secured means provided for example for a cap to be able to be removed only by movements that are a priori mutually contradictory.

The documents U.S. Pat. No. 6,112,921 and U.S. Pat. No. 7,641,064 describe, in this respect, closure devices comprising a cap intended to be screwed onto a coupling neck made of a single piece with a tank. The closure systems disclosed also comprise locking tabs that a user must compress to allow the cap screwed onto the coupling neck to be unscrewed and thus to be able to access the pharmaceutical product. These locking tabs, borne by the cap, present the drawback of being located in the usual cap gripping zone.

This type of closure device offers efficient operation but, since a child grasping the flask is very likely to grasp it by the cap, the positioning of the locking tabs on the cap can prove a nuisance in some circumstances.

SUMMARY OF THE INVENTION

The aim of the invention is to propose a closure device for a container provided with secured closure means that are effective and simple to use but that distance the locking tabs from the usual gripping zone of the closure device.

To this end, the subject of the invention is a closure device for a tank-forming container, of the type comprising:

a coupling member comprising an outer threading and intended to be borne by the tank, a cap comprising an inner threading and intended to be fitted onto the coupling member or to be removed from this coupling member by screwing or unscrewing, safety means comprising:

at least one circumferential locking abutment, and at least one locking tab that is elastically deformable radially between a position of rest in which the locking tab cooperates with the circumferential locking abutment to oppose the unscrewing of the cap and at least one retracted position of release of the locking tab relative to the circumferential abutment, the locking tab being borne by the coupling member and the circumferential locking abutment being borne by the cap, characterized in that the circumferential locking abutment forms a circumferential end of a gap formed in an edge of the cap delimiting an open end of this cap, the edge of this end being delimited by two outlines, a radially outer outline and a radially inner outline, respectively forming:

an outer cam profile intended to cooperate, during screwing, with the locking tab to displace it from the position to a radially outer retracted position of release, and an inner cam profile intended to cooperate, during unscrewing, with the locking tab to keep it in a radially inner retracted position of release.

Thus, to separate the cap from the retaining member, the user presses, with a first hand, on the locking tab to retract it radially. This releases the locking tab from the circumferential locking abutment. With a second hand, the user can then unscrew the cap from the container according to a usual gesture. Generally, a child does not coordinate these two gestures spontaneously, so that the closure of the container is secured effectively with respect to accidental handling by a child.

By virtue of the invention, the locking tab is, furthermore, outside of the probable zone of gripping of the cap by a child, because it is borne by the coupling member.

Furthermore, the gap forms a housing for the locking tab in position of rest, when the cap is fully screwed onto the coupling member.

The invention can also comprise the following optional features.

The circumferential locking abutment can comprise a notch favoring the contact between the locking tab and the circumferential locking abutment by partial fitting of this locking tab into the notch.

The locking tab can comprise at least one radially inner chamfer and one radially outer chamfer to facilitate the partial fitting of the locking tab into the notch.

The locking tab can comprise at least one radially inner chamfer and one radially outer chamfer to facilitate the cooperation with the cam profile-forming outlines of the cap.

Advantageously, the locking tab comprises a first axial linking end with the coupling member forming an articulation axis of this locking tab, this articulation axis being substantially tangential to the rotational movement of the cap during the screwing/unscrewing thereof.

Preferentially, the locking tab comprises a second axial end which is free, this free second axial end being less distant from the cap than the first axial linking end considering the cap in screwed position.

The coupling member can comprise protection ribs for the locking tab which are radially protuberant and intended to prevent an untimely radial tightening of this locking tab by a hand of a user enveloping the coupling member.

The coupling member can bear circumferential stabilization abutments intended to prevent a deformation of the locking tab in position of rest in case of attempted forced unscrewing.

Preferentially, the closure device comprises two substantially diametrically opposite locking tabs and two circumferential locking abutments associated with these two locking tabs.

Another subject of the invention is a medical device comprising a container and a closure device for this container, characterized in that the closure device is as claimed in the invention.

The medical device according to the invention can also comprise the following optional features:

- the container comprises a tank having a neck, the coupling member being mounted to rotate freely about the neck of the tank; or else
- the container comprises a tank having a neck, the coupling member being made of a single piece with the tank of the container;
- the container comprises a tank having a neck, the coupling member being mounted on the tank by screwing.

In the case where the coupling member is mounted to rotate freely about the neck of the tank, any attempt to unscrew the cap without prior radial retraction of the locking tab provokes a rotation of all of the closure device about the neck of the container, reducing the risk of application of inappropriate loads on the locking tab and the circumferential locking abutment.

BRIEF DESCRIPTION OF THE DRAWINGS

The invention will be better understood on reading the following description, given purely by way of example and with reference to the attached figures, in which.

DETAILED DESCRIPTION OF THE INVENTION

Figure 2:
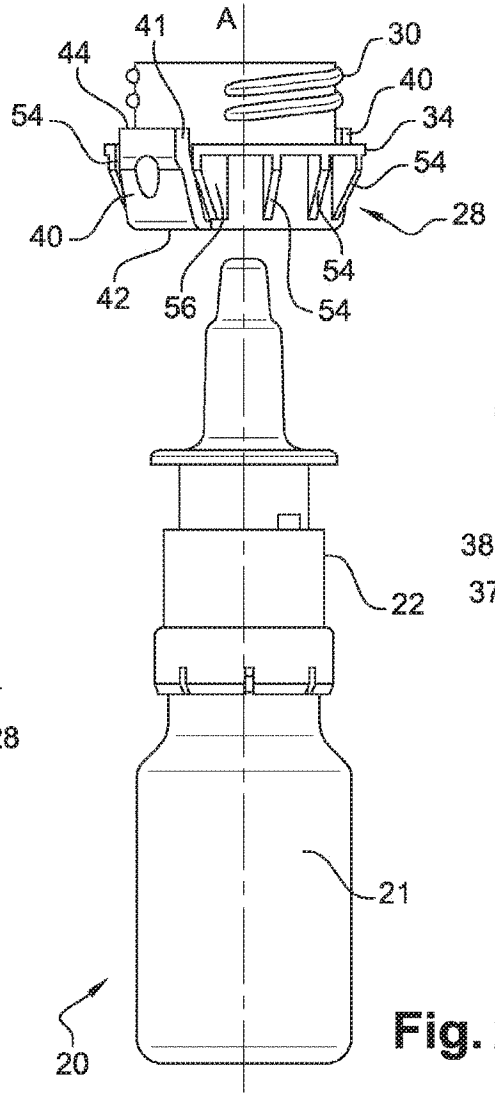
FIG. 2 is an exploded view showing a part of the elements of the medical device of FIG. 1.
Figure 1:
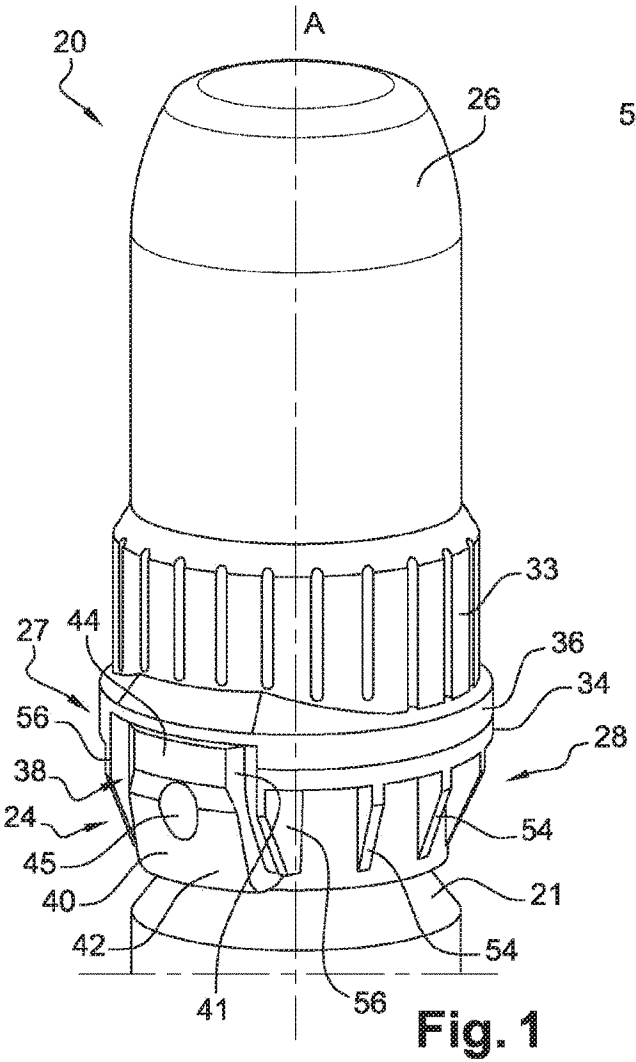
FIG. 1 is a partial perspective view of a medical device comprising a closure device provided with a cap in screwed position, according to the invention.

Now refer to FIGS. 1 and 2. These figures show a medical device 20 according to the invention. This medical device 20 comprises a tank-forming container 21 of general form of revolution about an axis A.

Hereinbelow, any reference to an axial direction will be given with reference to the axis A.

This tank 21 comprises a neck. Onto the neck of the tank 21 is added an end-fitting 22 for dispensing a product contained in the tank 21. As a variant, this dispensing end-fitting 22 could be made of a single piece with the neck of the tank 21.

The medical device 20 also comprises a closure device 24 for the tank 21.

This closure device 24 comprises a cap 26 of generally elliptical outer profile and comprising an open end 27, a ring-forming coupling member 28 of generally elliptical outer profile and safety means.

As can be seen in figure FIG. 2, the coupling member 28 is intended to be borne by the neck of the container 21. In the embodiment described, the coupling member 28 is mounted to rotate freely about the neck of the tank 21.

As a variant, the coupling member 28 could be is made of a single piece with the tank 21.

The container 21 and the coupling member 28 are for example produced in polypropylene (PP). The cap 26 is for example produced in polypropylene (PP) or in high-density polyethylene (HDPE).

Figure 3:
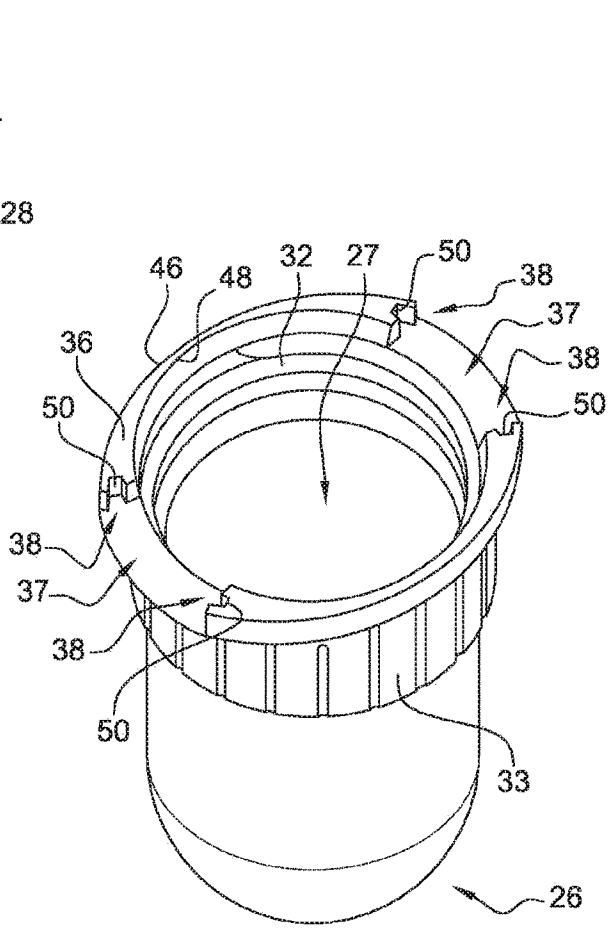
FIG. 3 is a perspective view of the cap of the medical device of FIG. 1.

The coupling member 28 comprises a substantially cylindrical portion provided with an outer threading 30 intended to cooperate with the cap 26. In fact, as can be seen in FIG. 3, the cap 26 comprises a substantially cylindrical portion provided with an inner threading 32 to allow it to be fitted onto the coupling member 28 by screwing or to be removed from the coupling member 28 by unscrewing. Preferably, the cap 26 comprises an annular gripping zone 33, comprising axial grooves, for example evenly distributed over the circumference of the cap 26, on which a user can place his or her fingers to screw or unscrew the cap 26.

Figure 6:
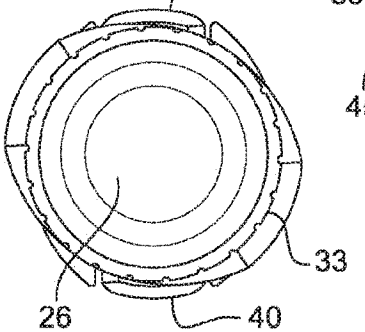
FIG. 6 is a plan view of the medical device of FIG. 1 during screwing.
Figure 4:
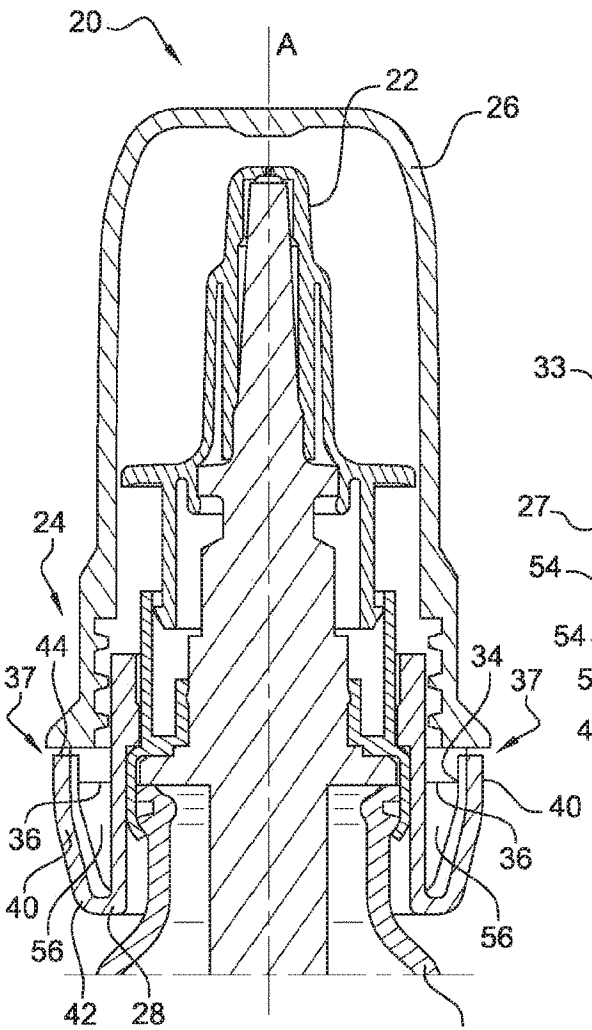
FIG. 4 is a partial view in axial cross section of the medical device of FIG. 1.

The coupling member 28 comprises, after the outer threading 30 considering the axial direction of screwing, a flange 34 forming an end-of-screwing travel abutment. As can be seen in FIG. 6, this flange 34 has an overall elliptical outer profile. As can be seen in FIG. 4 in particular, this end-of-screwing travel abutment is intended to cooperate with a complementary surface 36 formed by the edge of the cap 26 delimiting the open end 27 thereof.

According to another embodiment not represented, the end-of-screwing travel abutment can be defined by abutments provided at the end of outer and inner threadings, or by any other equivalent means.

As can be seen in FIG. 3, two substantially radially opposite gaps 37 are formed in the edge of the cap 26 delimiting its open end 27, at the ends most distant from its overall elliptical outer profile. Each gap is topped by an inclined border 39, linking the overall elliptical outer profile of the open end 27 to the rest of the cap 26, and thus preventing access, after the screwing of the cap 26, to the free second axial end 44 of the corresponding locking tab 40.

Moreover, the safety means comprise:

- four circumferential locking abutments 38 borne by the cap 26, and
- two substantially diametrically opposite locking tabs 40 borne by the coupling member 28 at the ends most distant from its overall elliptical outer profile.

Each locking tab 40 is associated with an active circumferential locking abutment 38. It will be noted in fact that only two circumferential locking abutments 38 are active, the other two being justified essentially for reasons of symmetry of the cap 26.

Figure 11:
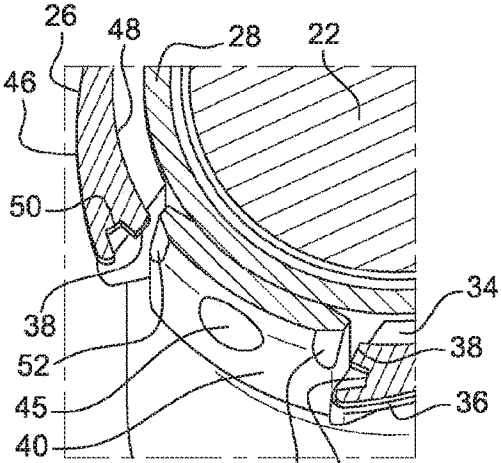
FIGS. 11 to 13 are views similar to FIGS. 8 to 10 showing different relative positions of the locking tab of the closure device when the cap is being unscrewed.
Figure 12:
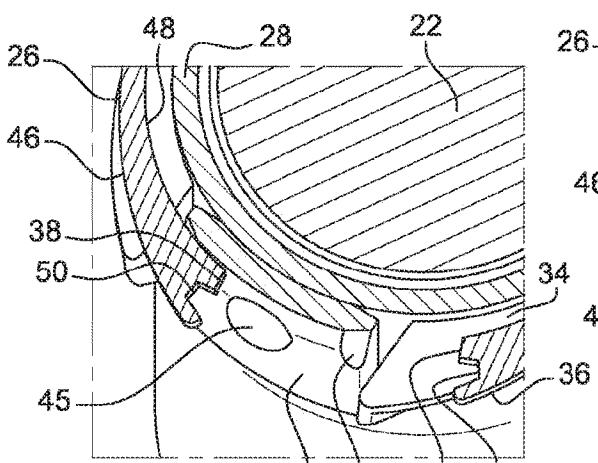

The locking tabs 40 of the coupling member 28 are each elastically deformable radially between a position of rest and two different retracted positions of release:

- a radially outer retracted position (as can be seen in FIG. 6 in particular), and
- a radially inner retracted position (as can be seen in FIG. 11 in particular).

These different retracted positions are described in more detail hereinbelow.

The locking tabs 40 extend axially beyond the complementary surface 36 so that, during the screwing thereof, the cap 26 cooperates with the locking tabs 40 before cooperating with the complementary surface 36.

When the cap 26 is screwed onto the coupling member 28, an edge 41 of each locking tab 40 in position of rest cooperates with a corresponding circumferential locking abutment 38 to oppose the unscrewing of the cap 26, as illustrated in FIG. 1.

In effect, each circumferential locking abutment 38 forms a circumferential end of a gap 37 (see FIGS. 3 and 4).

As can be seen in FIG. 2, each locking tab 40 borne by the coupling member 28 comprises a first axial linking end 42 with the coupling member 28. This axial linking end 42 thus forms an articulation axis 42 of the locking tab 40 and this articulation axis 42 is substantially tangential to the rotational movement of the cap 26 during the screwing/unscrewing thereof according to the axis A.

Each locking tab 40 also comprises a second axial end 44 which is free. As can be seen in FIGS. 1 and 2, the first axial linking end 42 is more distant from the tank 21 than the free second axial end 44 considering the cap 26 in screwed position.

Each locking tab 40 also comprises, on its circumferential face, an indentation 45 for positioning a finger of a user.

The open end edge 27 of the cap 26 is, moreover, delimited by two outlines: a radially outer outline 46 and a radially inner outline 48.

The radially outer outline 46 forms an outer cam profile 46 intended to cooperate, during screwing, with the locking tabs 40 to displace them from their position of rest to their radially outer retracted position of release.

The radially inner outline 48 forms an inner cam profile 48 intended to cooperate, during unscrewing, with the locking tabs 40 to keep them in their radially inner retracted position of release.

To favor the contact between each circumferential locking abutment 38 borne by the cap 26 and the edges 41 of the locking tabs 40 in position of rest, a notch 50 is formed in each circumferential locking abutment 38. These notches 50 favor the contact between the edges 41 of the locking tabs 40 of the coupling member 28 and the circumferential locking abutments 38 of the cap 26 by partial fitting of each locking tab 40 into the notches 50.

Figure 8:
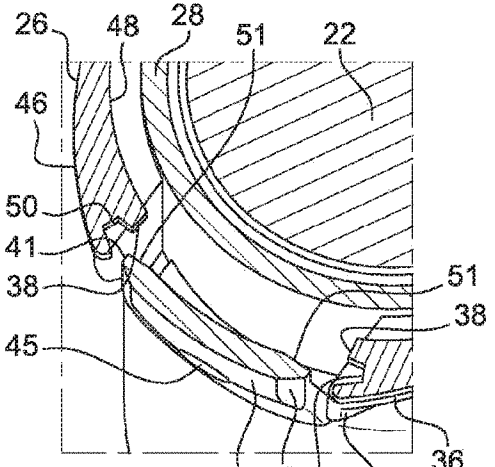
FIGS. 8 to 10 are partial views in transverse cross section of the medical device of FIG. 1 showing different positions likely to be taken by the locking tab of the closure device when the cap is in screwed position.

Moreover, and as can be seen in FIG. 8, to facilitate the cooperation between each locking tab 40 and the outer and inner cam profile-forming outlines 46, 48 of the cap 26, each locking tab 40 comprises two radially inner chamfers 51 and two radially outer chamfers 52.

In order to prevent an untimely radial tightening of the locking tabs 40 by the hand of a user enveloping the coupling member 28, the coupling member 28 comprises protection ribs 54 for the locking tabs 40. These protection ribs 54 are radially protuberant and therefore prevent an untimely radial tightening, notably by the palm of a hand of a child.

In addition to these protection ribs 54, the coupling member 28 bears circumferential stabilization abutments 56 intended to prevent a deformation of the locking tabs 40 in position of rest in case of attempted forced unscrewing. These circumferential stabilization abutments 56 correspond to the protection ribs 54 disposed on either side of each locking tab 40. For the comfort of the user, the circumferential stabilization abutments 56 have a rounded profile, that can be seen in FIGS. 8 to 13, oriented toward the corresponding locking tab 40.

Below is a description of the main steps of handling the medical device 20 according to the invention.

Figure 7:
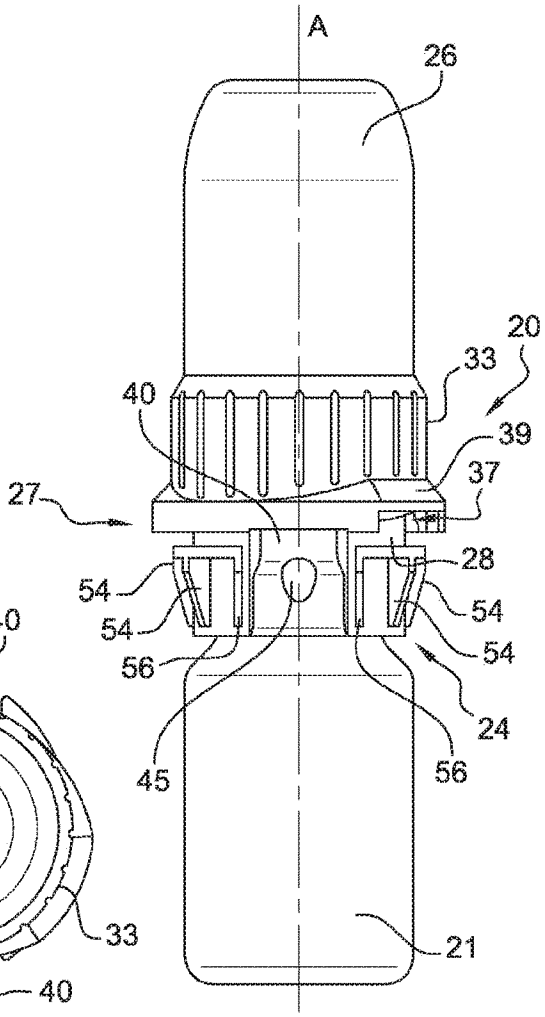
FIG. 7 is a view similar to FIG. 5, the cap being screwed.
Figure 5:
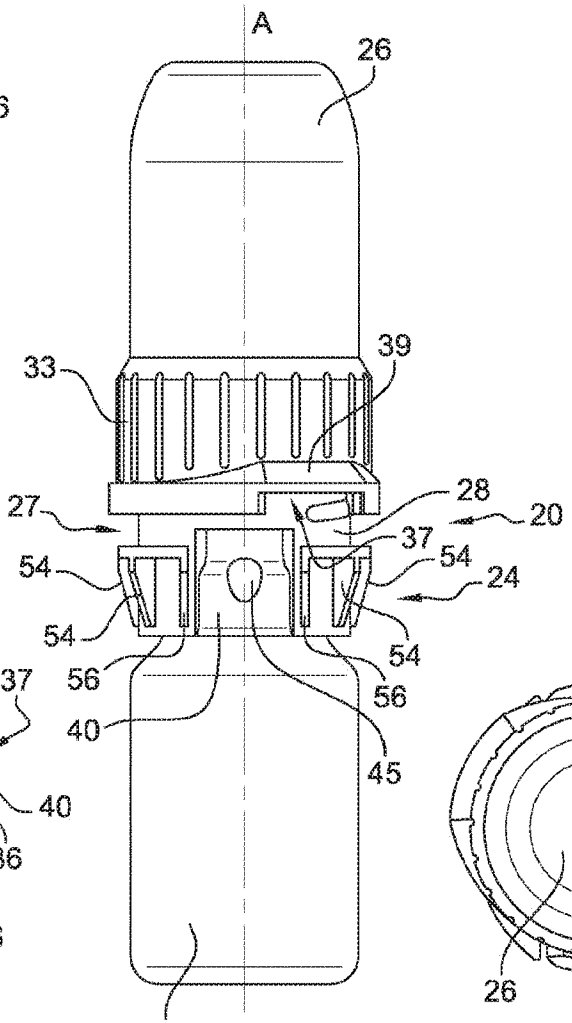
FIG. 5 is an elevation view of the medical device of FIG. 1, the cap being screwed.

Consider first of all the medical device 20 during screwing as represented in FIGS. 5, 6 and 7. In this case, the two substantially diametrically opposite locking tabs 40 are in position of rest. A user wanting to close the medical device 20 screws the cap 26 onto the coupling member 28 by a usual gesture.

When the cap 26 is, axially (parallel to the axis A), sufficiently close to the tank 21 for the outer outline 46 of the cap 26, in the flattened portions of its overall elliptical outer profile, to enter into contact with the locking tabs 40, there is cooperation by ramp effect between the radially inner chamfers 51 of the locking tabs 40 and the outer cam profile 46 of the cap 26. Because of the overall elliptical outer profile of the outer outline 46 of the cap 26, this cooperation radially displaces, by elastic deformation and pivoting about the articulation axis 42, each locking tab 40 toward its outer retracted position of release (see FIGS. 6 and 7) and thus allows the user to finish screwing the cap 26 onto the coupling member 28. The screwing is finished when the complementary surface 36 of the edge of the cap 26 enters into contact with the end-of-screwing travel abutment of the flange 34.

When the screwing of the cap 26 onto the coupling member 28 is finished, each locking tab 40 is located facing a gap 37 and, since the contact with the outer outline 46 of the cap 26 is broken, each locking tab 40 can thus pivot once again about its articulation axis 42 and revert to its position of rest by elastic deformation.

Figure 9:
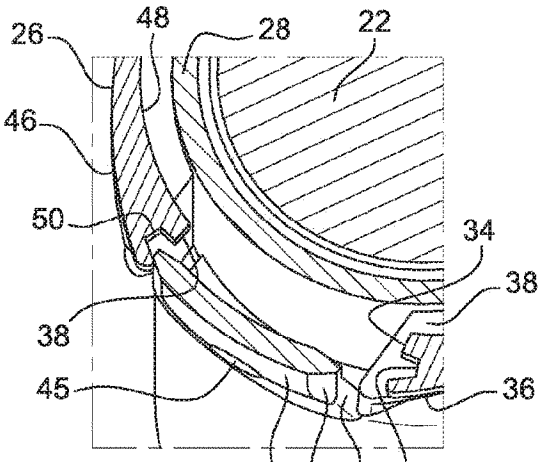
Figure 10:
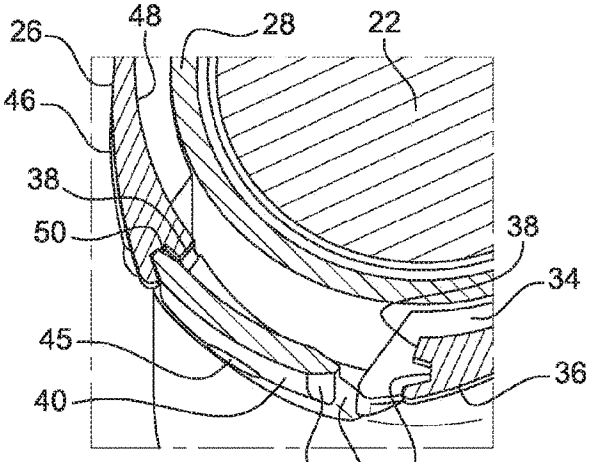

As can be seen in FIGS. 8, 9 and 10, when the locking tabs 40 are in position of rest, it is not possible to unscrew the cap 26 from the coupling member 28. In fact, in this configuration, any attempted circumferential displacement of the cap 26 about the coupling member 28 culminates in the fitting of the locking tabs 40 into the notches 50 formed in the circumferential locking abutments 38 borne by the cap 26.

In effect, the notch 50 of each circumferential locking abutment 38 is capable of receiving the corresponding locking tab 40 and of circumferentially locking it in its position of rest in case of an untimely initiation of unscrewing of the cap 26, that is to say without prior displacement, by a user, of the locking tab 40 to its radially inner retracted position of release.

In case of attempted circumferential displacement of the cap 26 about the coupling member 28 with the locking tabs 40 in position of rest, the radially inner and outer chamfers 51, 52 favor the engaging of the locking tabs 40 in the notches 50, thus preventing the locking tabs 40 from escaping from the notches 50. Furthermore, in such a configuration, the circumferential stabilization abutments 56 limit the torsional deformation of the notches 50 which cannot be released from the notches 50.

Moreover, when the coupling member 28 is mounted to rotate freely about the neck of the tank 21, the attempted unscrewing can lead to the rotation of the coupling member 28 relative to the neck of the tank 21, commensurately limiting the pressing points to open the medical device 20.

To open the medical device 20 and separate the cap 26 from the coupling member 28, a user must therefore first radially retract the locking tabs 40.

To do this, as illustrated in FIG. 11, the user places two fingers around the coupling member 28, one on each locking tab 40. The positioning hollows 45 allow the user to position his or her fingers easily.

Figure 13:
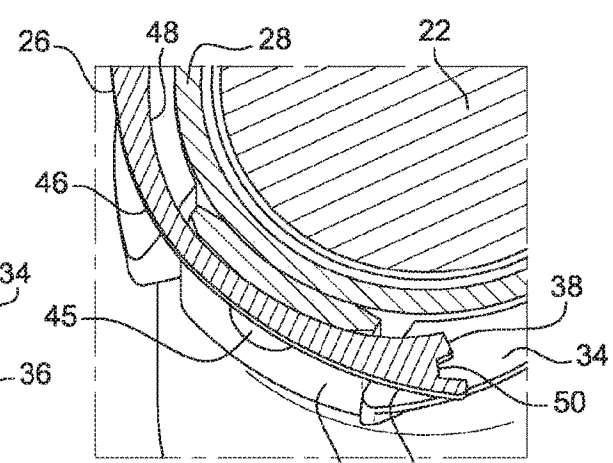

The user then presses on each locking tab 40 to deform it elastically and thus make each pivot about its articulation axis 42 and displace it to its radially inner retracted position as illustrated in FIG. 11. With his or her free hand, the user can then grasp the cap 26 by the gripping zone 33 and begin to unscrew it according to a usual gesture. When the unscrewing has begun, the inner outline 48 of the end edge of the cap 26 enters into contact with the radially outer chamfers 52 of each locking tab 40. The inner outline 48 then cooperates by ramp effect with the radially outer chamfers 52 (see FIG. 12) and keeps each locking tab 40 in its radially inner retracted position during the start of the unscrewing of the cap 26, as can be seen in FIG. 13, until the cap 26 is beyond the free second axial ends 44 of the locking tabs 40. Once released, the locking tabs 40 revert to position of rest by elastic deformation.

The invention is not limited to the embodiments presented and other embodiments will become clearly apparent to a person skilled in the art.

Figure 14:
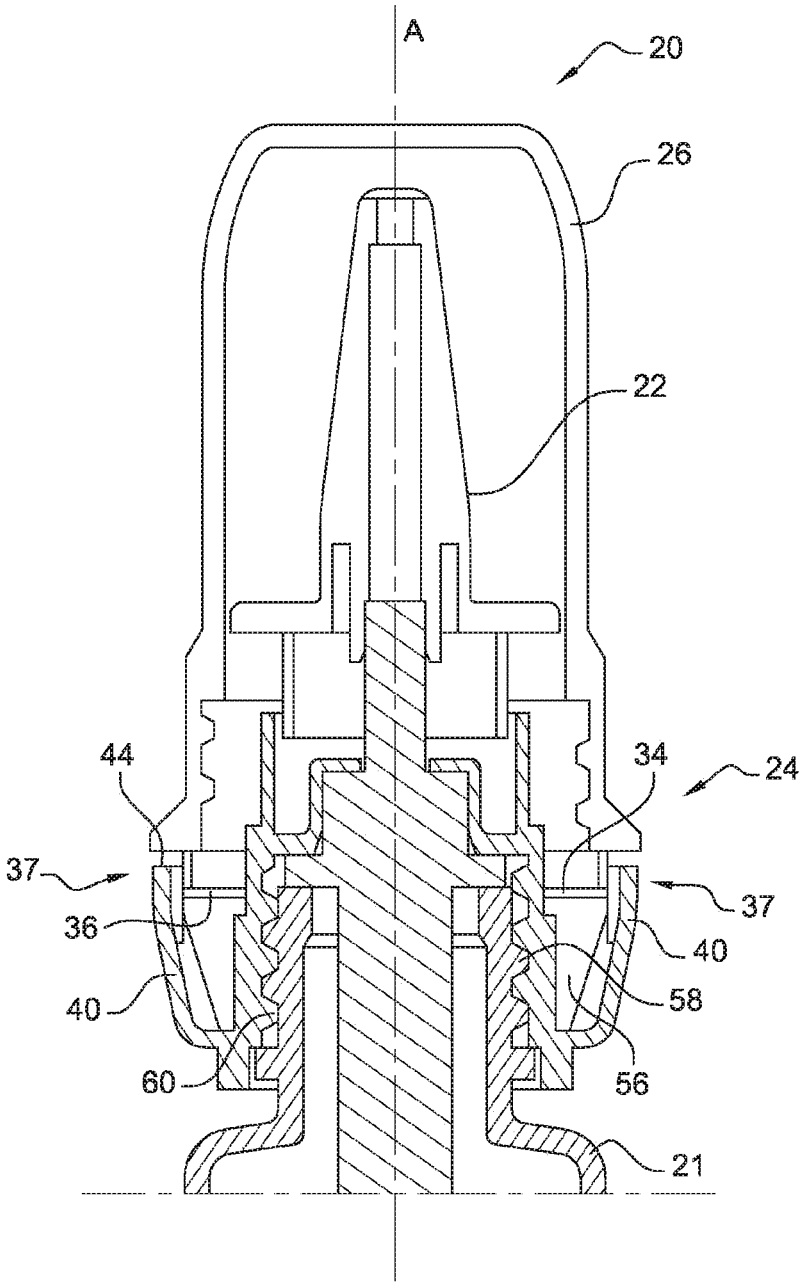
FIG. 14 represents a cross-sectional view similar to FIG. 4 of a medical device comprising a closure device according to a second embodiment of the invention.

Below is a description, referring to FIG. 14, of a medical device 20 according to a second embodiment of the invention. In this case, the elements similar to those of the preceding figures are designated by identical references.

In this embodiment, the closure device 24 is mounted on the tank 21 by screwing. The means for screwing the closure device onto the tank 21 comprise first 58 and second 60 threadings formed respectively on the tank 21 and the closure device 24.

The invention claimed is:

1. A closure device for a tank-forming container, comprising:

a coupling member comprising an outer threading and intended to be borne by the tank, a cap comprising an inner threading and intended to be fitted onto the coupling member or to be removed from this coupling member by screwing or unscrewing, safety features comprising:

at least one circumferential locking abutment, and at least one locking tab that is elastically deformable radially between a position of rest in which the locking tab cooperates with the circumferential locking abutment to oppose the unscrewing of the cap and at least one retracted position of release of the locking tab relative to the circumferential abutment, the locking tab being borne by the coupling member and the circumferential locking abutment being borne by the cap, characterized in that the circumferential locking abutment forms a circumferential end of a gap formed in an edge of the cap delimiting an open end of this cap, the edge of this open end being delimited by two outlines, a radially outer outline and a radially inner outline, respectively forming:

an outer cam profile intended to cooperate, during screwing, with the locking tab to displace it from the position of rest to a radially outer retracted position of release, and an inner cam profile intended to cooperate, during unscrewing, with the locking tab to keep it in a radially inner retracted position of release.

2. The closure device according to claim 1, in which the circumferential locking abutment comprises a notch favoring the contact between the locking tab and the circumferential locking abutment by partial fitting of this locking tab into the notch.

3. The closure device according to claim 2, in which the locking tab comprises at least one radially inner chamfer and one radially outer chamfer to facilitate the partial fitting of the locking tab into the notch.

4. The closure device according to claim 1, in which the locking tab comprises at least one radially inner chamfer and one radially outer chamfer to facilitate the cooperation with the cam profile-forming outlines of the cap.

5. The closure device according to claim 1, in which the locking tab comprises a first axial linking end with the coupling member forming an articulation axis of the locking tab, the articulation axis being substantially tangential to the rotational movement of the cap during the screwing/unscrewing thereof.

6. The closure device according to claim 5, in which the locking tab comprises a second axial end which is free, this free second axial end being less distant from the cap than the first axial linking end considering the cap in screwed position.

7. The closure device according to claim 1, in which the coupling member comprises protection ribs for the locking tab which are radially protuberant and intended to prevent an untimely radial tightening of this locking tab by a hand of a user enveloping the coupling member.

8. The closure device according to claim 1, in which the coupling member bears circumferential stabilization abutments intended to prevent a deformation of the locking tab in position of rest in case of attempted forced unscrewing.

9. The closure device according to claim 1, comprising two substantially diametrically opposite locking tabs and two circumferential locking abutments associated with these two locking tabs.

10. A medical device comprising a container and a closure device for this container, characterized in that the closure device is according to claim 1.

11. The medical device according to claim 10, in which the container comprises a tank having a neck and in which the coupling member is mounted to rotate freely about the neck of the tank.

12. The medical device according to claim 10, in which the container comprises a tank having a neck and in which the coupling member is made of a single piece with the tank of the container.

13. The medical device according to claim 10, in which the container comprises a tank having a neck and in which the coupling member is mounted on the container by screwing.

14. The closure device according to claim 3, in which the locking tab comprises a first axial linking end with the coupling member forming an articulation axis of the locking tab, the articulation axis being substantially tangential to the rotational movement of the cap during the screwing/unscrewing thereof.

15. The closure device according to claim 6, in which the coupling member comprises protection ribs for the locking tab which are radially protuberant and intended to prevent an untimely radial tightening of this locking tab by a hand of a user enveloping the coupling member.

16. The closure device according to claim 15, in which the coupling member bears circumferential stabilization abutments intended to prevent a deformation of the locking tab in position of rest in case of attempted forced unscrewing.

17. The closure device according to claim 16, comprising two substantially diametrically opposite locking tabs and two circumferential locking abutments associated with these two locking tabs.

* * * * *